US006568986B2

(12) United States Patent
Kobayashi

(10) Patent No.: US 6,568,986 B2
(45) Date of Patent: May 27, 2003

(54) TOY FIGURE

(75) Inventor: Muneto Kobayashi, Ichikawa (JP)

(73) Assignee: Tomy Company, Ltd., Tokyo (JP)

( * ) Notice: Subject to any disclaimer, the term of this patent is extended or adjusted under 35 U.S.C. 154(b) by 0 days.

(21) Appl. No.: 10/106,195

(22) Filed: Mar. 27, 2002

(65) Prior Publication Data

US 2002/0155782 A1 Oct. 24, 2002

(30) Foreign Application Priority Data

Apr. 18, 2001 (JP) ..... 2001-119894

(51) Int. Cl.[7] ..... A63H 3/00
(52) U.S. Cl. ..... 446/268; 446/98
(58) Field of Search ..... 446/268, 97, 98, 446/100, 376, 378, 72, 119, 120, 121, 373, 374

(56) References Cited

U.S. PATENT DOCUMENTS 2,506,328 A * 5/1950 Alger
2,808,681 A * 10/1957 Arenstein
3,768,197 A * 10/1973 Shimamura
3,783,554 A * 1/1974 Shapero
4,185,412 A * 1/1980 Rahmstorf
4,227,340 A * 10/1980 Goldfarb et al.
4,356,659 A * 11/1982 Clarke
4,595,378 A * 6/1986 Sweet et al. ..... 446/99
5,022,886 A * 6/1991 Jenkins ..... 446/268
5,454,746 A * 10/1995 Guegan et al. ..... 446/72
5,480,341 A * 1/1996 Plakos ..... 446/373

FOREIGN PATENT DOCUMENTS

JP 06098978 A * 4/1994

* cited by examiner

*Primary Examiner*—Derris H. Banks
*Assistant Examiner*—Ali F Abdelwahed
(74) *Attorney, Agent, or Firm*—Staas & Halsey LLP

(57) ABSTRACT

A toy figure comprising a structure suitable to put on and take off a skirt or trousers. The toy figure comprises: an upper half body comprising a body concavity formed on a lower end surface thereof so as to have a small diametrical concave portion and a large diametrical concave portion below the small diametrical concave portion; a lower half body comprising a body projection provided on an upper end surface thereof so as to be fitted in the small diametrical concave portion; and a bottom comprising a front bottom piece and a back bottom piece which are capable of being separated from each other forward and backward and which have external half ring-like cylindrical projections for covering a lower portion of the body projection from a front and a back so as to be fitted in the large diametrical concave portion.

13 Claims, 8 Drawing Sheets

TOY FIGURE

This application claims the benefit of Japanese Patent Application No. 2001-119894, filed Apr. 18, 2001, in the Japanese Intellectual Property Office, the disclosure of which is incorporated herein by reference.

BACKGROUND OF THE INVENTION

1. Field of the Invention

The present invention relates to a toy figure, and in particular to a small-sized toy figure.

2. Description of Related Art

Generally, capsules each of which contains component parts of a small-sized toy figure, for example, an upper half body, a lower half body, and a skirt of the toy figure, therein, are sold.

For example, as shown in FIG. 4, the small-sized toy figure contained in the capsule comprises an upper half body 50, a lower half body 60 and a skirt 70, which are molded parts made of synthetic resin. The small-sized toy figure is constituted, as follows. The upper half body 50, the lower half body 60 and the skirt 70 can be separated from each other. A projection 51 is provided at a lower end surface of the upper half body 50. A concavity 61 in which the projection 51 is fitted is formed at an upper end surface of the lower half body 60. When the projection 51 is fitted into the concavity 61, the upper half body 50 is connected to the lower half body 60. The skirt 70 is stayed at a hips portion of the lower half body 60. The skirt 70 comprises a front skirt piece 71 and a back skirt piece 72, which can be separated from each other.

Further, as shown in FIG. 5, the small-sized toy figure may comprise a skirt 80 an upper portion of which are held between the upper half body 50 and the lower half body 60.

As described above, in case the skirt 70 is stayed at the hips portion, and in case the upper portion of the skirt 80 is held between the upper half body 50 and the lower half body 60, it is easy that the front skirt piece 71 and the back skirt piece 72 of the skirt 70 get out of fit rightward and leftward or are separated from each other forward and backward, and also a front skirt piece 81 and a back skirt piece 82 of the skirt 80 get out of fit rightward and leftward or are separated from each other forward and backward. In order to prevent the above-described cases, when projections 73 are provided at the back skirt piece 72 which is one piece of two skirt pieces, and concavities 74 in which the projections 73 can be fitted are formed at the front skirt piece 71 which is the other of two skirt pieces, the projections 73 are fitted into the concavities 74. As well, when projections 83 are provided at the back skirt piece 82, and concavities 84 are formed at the front skirt piece 81, the projections 83 are fitted into the concavities 84. In cases, the projections 73 and the concavities 74, and the projections 83 and the concavities 84 are generally provided at edge portions of the skirt pieces 72 and 71, and edge portions of the skirt pieces 82 and 81, respectively.

However, when parts of the toy figure are molded, it is necessary to take a shrinkage cavity of molded parts made of synthetic resin into consideration.

That is, in case the skirt pieces 71 and 72 are molded, the skirt pieces 71 and 72 are shrunk by the shrinkage cavity. As a result, the case occurs that the projections 73 provided at the back skirt piece 72 are not fitted into the concavities 74 formed at the front skirt piece 71 well. In the case, because it is impossible to effectively prevent the skirt pieces 71 and 72 from getting out of fit rightward and leftward or being separated from each other forward and backward, the attraction of the small-sized toy figure is lost.

Further, in order to prevent a right and left gap and a front and rear space from occurring between the skirt pieces 71 and 72, it is necessary to fit the projections 73 into the concavities 74 exactly. However, the case occurs that measurement errors of the projections 73 and concavities 74 are caused by the shrinkage cavity and the projections 73 are not fitted into the concavities 74 well.

The above-described problems occurs not only in case the small-sized toy figure comprises the skirt but also in case the small-sized toy figure comprises a pair of trousers having trousers pieces which can be separated from each other forward and backward.

SUMMARY OF THE INVENTION

The present invention was developed in view of the above-described problems.

An object of the present invention is to provide a toy figure comprising a structure suitable to put on and take off a skirt or trousers.

In accordance with a first aspect of the present invention, a toy figure comprises:

an upper half body (for example, an upper half body 20 shown in FIG. 1) comprising a body concavity (for example, a concavity 21 show in FIG. 1) which is formed at a predetermined position on a lower end surface thereof so as to have a small diametrical concave portion (for example, a small diametrical concave portion 21*a* shown in FIG. 2) and a large diametrical concave portion (for example, a large diametrical concave portion 21*b* shown in FIG. 2) below the small diametrical concave portion;

a lower half body (for example, a lower half body 10 shown in FIG. 1) comprising a body projection (for example, a projection 11 shown in FIG. 1) which is provided at a predetermined position on an upper end surface thereof so as to be fitted in the small diametrical concave portion of the body concavity; and a bottom (for example, a skirt 30 shown in FIG. 1) comprising a front bottom piece and a back bottom piece which are capable of being separated from each other forward and backward and which have external half ring-like cylindrical projections (for example, half cylindrical projections 31*a* and 32*a* shown in FIG. 1) for covering a lower portion of the body projection from a front and a back so as to be fitted in the large diametrical concave portion of the body concavity.

Herein, the toy figure means a toy formed so as to imitate a human, an animal, an animated character or the like. Further, because the body concavity has the small diametrical concave portion and the large diametrical concave portion below the small diametrical concave portion, the body concavity is formed in a shape like an inverse "T". Furthermore, the external half ring-like cylindrical projections of the front bottom piece and the back bottom piece are projected to the exterior of the bottom, and make a circle when the front bottom piece and the back bottom piece are connected to each other.

According to the toy figure of the first aspect of the present invention, the external half ring-like cylindrical projections provided at the bottom are fitted in the large diametrical concave portion of the body concavity, and the body projection provided at the lower half body is fitted in the small diametrical concave portion of the body concavity.

As a result, because the front bottom piece and the back bottom piece which are capable of being separated from each other forward and backward are not only held between the upper half body and the lower half boy but also fixed by the fit of the external half ring-like cylindrical projections in the large diametrical concave portion, it is possible to more effectively prevent the front bottom piece and the back bottom piece from getting out of fit and being separated from each other.

Further, because the body concavity of the upper half body is formed in a shape like an inverse "T", a pin made of metal, for making the shape like an inverse "T" at the predetermined position of the upper half body has a shape like an inverse "T". Therefore, a bottom portion of the pin is strong. As a result, it is possible to reduce a danger of the pin's bending, warping or breaking, and to reduce a necessary cost for a maintenance of the pin.

Preferably, in the toy figure of the first aspect of the present invention, a bottom concavity is formed at one of the front bottom piece and the back bottom piece, and a bottom projection is provided at the other of the front bottom piece and the back bottom piece so as to be fitted in the bottom concavity.

According to the above-described toy figure, the bottom concavity is formed at one of the front bottom piece and the back bottom piece to position the one of them to the other of them, and the bottom projection is provided at the other of the front bottom piece and the back bottom piece to position the other of them to the one of them. However, because the bottom concavity and the bottom projection are provided in order to position the front bottom piece and the back bottom piece to the utmost, it is sufficient that the bottom projection is loosely fitted in the bottom concavity. As a result, because it is sufficient even if the accuracy of the measures of the bottom concavity and the bottom projection is low, any problem is not caused by the large or small measure's error.

Preferably, in the toy figure of the first aspect of the present invention, a bottom concavity is formed at a predetermined position of a concavity-side's contact portion at which the front bottom piece and the back bottom piece are contacted with each other, of one of the front bottom piece and the back bottom piece, and a bottom projection is provided at a predetermined position of a projection-side's contact portion at which the front bottom piece and the back bottom piece are contacted with each other, of the other of the front bottom piece and the back bottom piece so as to be fitted in the bottom concavity.

Preferably, in the toy figure of the first aspect of the present invention, a bottom concavity is formed at a predetermined position of a concavity-side's inseam portion at which the front bottom piece and the back bottom piece are contacted with each other, of one of the front bottom piece and the back bottom piece, and a bottom projection is provided at a predetermined position of a projection-side's inseam portion at which the front bottom piece and the back bottom piece are contacted with each other, of the other of the front bottom piece and the back bottom piece so as to be fitted in the bottom concavity.

Preferably, in the toy figure of the first aspect of the present invention, the bottom is any one of a skirt and a pair of trousers.

Preferably, in the toy figure of the first aspect of the present invention, the upper half body, the lower half body and the bottom are molded parts made of synthetic resin.

In accordance with a second aspect of the present invention, a toy figure comprises:

an upper half body (for example, an upper half body 20 shown in FIG. 1 or 6) comprising one of a body concavity having a large diametrical concave portion (for example, a large diametrical concave portion 21*b* shown in FIG. 2 or 6) and a small diametrical concave portion (for example, a small diametrical concave portion 21*a* shown in FIG. 2 or 6) formed at a predetermined position on a bottom surface of the large diametrical concave portion, and a body projection (for example, a projection 11 shown in FIG. 1 or 6), at a predetermined position on a lower end surface thereof;

a lower half body (for example, a lower half body 10 shown in FIG. 1 or 6) comprising the other of the body concavity and the body projection at a predetermined position on an upper end surface thereof so that the body projection is fitted in the small diametrical concave portion; and a bottom (for example, a skirt 30 or 30' shown in FIG. 1 or 6) comprising a ring-like cylindrical projection (for example, half cylindrical projections 31*a* and 32*a* or 31*a'* and 32*a'* shown in FIG. 1 or 6) for covering a portion of the body projection, which is not fitted in the small diametrical concave portion so that the ring-like cylindrical projection is fitted in the large diametrical concave portion, at an external upper surface thereof when the body projection is provided at the lower half body and the body concavity is formed at the upper half body (for example, a case shown in FIG. 1) or at an internal upper surface thereof when the body projection is provided at the upper half body and the body concavity is formed at the lower half body (for example, a case shown in FIG. 6).

In accordance with a third aspect of the present invention, a toy figure comprises:

an upper half body (for example, an upper half body 20 shown in FIG. 7 or 8) comprising one of a large diametrical concavity (for example, a large diametrical concave portion 21*b* shown in FIG. 7 or 8) including a body projection (for example, a projection 11 shown in FIG. 7 or 8) provided at a predetermined position on a bottom surface of the large diametrical concavity, and a small diametrical concavity (for example, a small diametrical concave portion 21*a* shown in FIG. 7 or 8), at a predetermined position on a lower end surface thereof;

a lower half body (for example, a lower half body 10 shown in FIG. 7 or 8) comprising the other of the large diametrical concavity including the body projection and the small diametrical concavity at a predetermined position on an upper end surface thereof so that the body projection is fitted in the small diametrical concavity; and a bottom (for example, a skirt 30' or 30 shown in FIG. 7 or 8) comprising a ring-like cylindrical projection (for example, half cylindrical projections 31*a'* and 32*a'* or 31*a* and 32*a* shown in FIG. 7 or 8) for covering a portion of the body projection, which is not fitted in the small diametrical concavity so that the ring-like cylindrical projection is fitted in the large diametrical concavity, at an external upper surface when the large diametrical concavity is formed at the upper half body and the small diametrical concavity is formed at the lower half body (for example, a case shown in FIG. 8) or at an internal upper surface when the large diametrical concavity is formed at the lower half body and the small diametrical concavity is formed at the upper half body (for example, a case shown in FIG. 7).

Preferably, in the toy figure of the second or third aspect of the present invention, the bottom comprises a front bottom piece and a back bottom piece which are capable of being separated from each other forward and backward, the front bottom piece comprises a front half of the ring-like cylindrical projection, and the back bottom piece comprises a back half of the ring-like cylindrical projection.

BRIEF DESCRIPTION OF THE DRAWINGS

The present invention will become more fully understood from the detailed description given hereinafter and the accompanying drawings which are given by way of illustration only, and thus are not intended as a definition of the limits of the present invention, and wherein.

PREFERRED EMBODIMENT OF THE INVENTION

Hereinafter, an embodiment of a toy figure of the present invention will be explained with reference to FIGS. 1 to 3, in detail.

Figure 1:
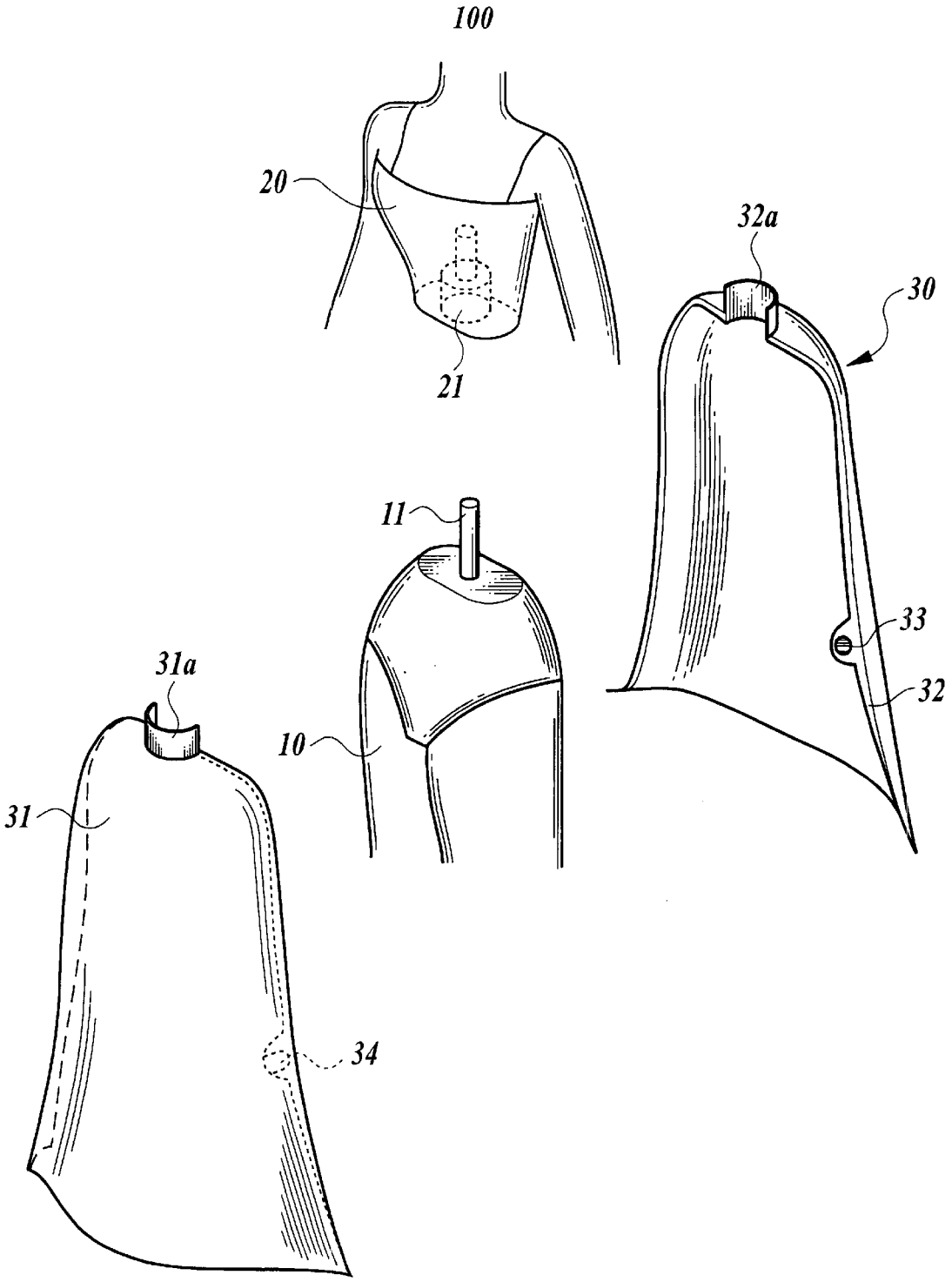
FIG. 1 is a perspective view showing an attachment structure of a skirt of a toy figure according to an embodiment of the present invention.

FIG. 1 shows a toy figure 100 according to an embodiment of the present invention.

The toy figure 100 comprises a lower half body 10, an upper half body 20 and a skirt 30 which are molded parts made of synthetic resin. The lower half body 10 may be constituted so as to attach leg pieces under knees thereto and detach the leg pieces therefrom. Further, the upper half body 20 may be constituted so as to attach a neck and a head or arms and hands thereto and detach the neck and the head or the arms and the hands therefrom.

A cylindrical projection 11 is provided at a predetermined position on an upper end surface of the lower half body 10 of the toy figure 100. On the other hand, a concavity 21 in which the projection 11 can be fitted is formed in inverse "T" at a predetermined position on a lower end surface of the upper half body 20. Further, the concavity 21 comprises a small diametrical concave portion 21*a* at an upper portion thereof and a large diametrical concave portion 21*b* at a lower portion thereof, below the small diametrical concave portion 21*a*, as shown in FIG. 2. Therefore, the projection 11 is fitted in the small diametrical concave portion 21*a* of the concavity 21. When the projection 11 is fitted into the concave portion 21*a*, the lower half body 10 is connected to the upper half body 20.

The skirt 30 comprises a front skirt piece 31 and a back skirt piece 32 which can be separated from each other forward and backward. Upper end portions of the skirt pieces 31 and 32 are extended so as to stay on the upper end surface of the lower half body 10. Half cylindrical projections 31*a* and 32*a* are provided at the upper end portions of the skirt pieces 31 and 32 respectively. The half cylindrical projections 31*a* and 32*a* have forms and length to cover a lower portion except a top portion of the projection 11 from the front and the rear of the lower half body 10. The half cylindrical projections 31*a* and 32*a* are fitted in the large diametrical concave portion 21*b* of the concavity 21 shown in FIG. 2 in state the half cylindrical projections 31*a* and 32*a* covers the projection 11 from the front and the rear of the lower half body 10.

A projection 34 for positioning the front skirt piece 31 to the back skirt piece 32 is provided at a predetermined position of a contact portion of the front skirt piece 31 with the back skirt piece 32. On the other hand, a concavity 33 for positioning the back skirt piece 32 to the front skirt piece 31 is formed at predetermined position corresponding to the projection 34, of a contact portion of the back skirt piece 32 with the front skirt piece 31.

The structure of the toy figure 100 has been described above. Next, it will be explained how to attach the skirt 30 to and detach it from the lower half body 10 and the upper half body 20.

First, it will be explained how to attach the skirt 30 to the lower half body 10 and the upper half body 20.

Figure 2:
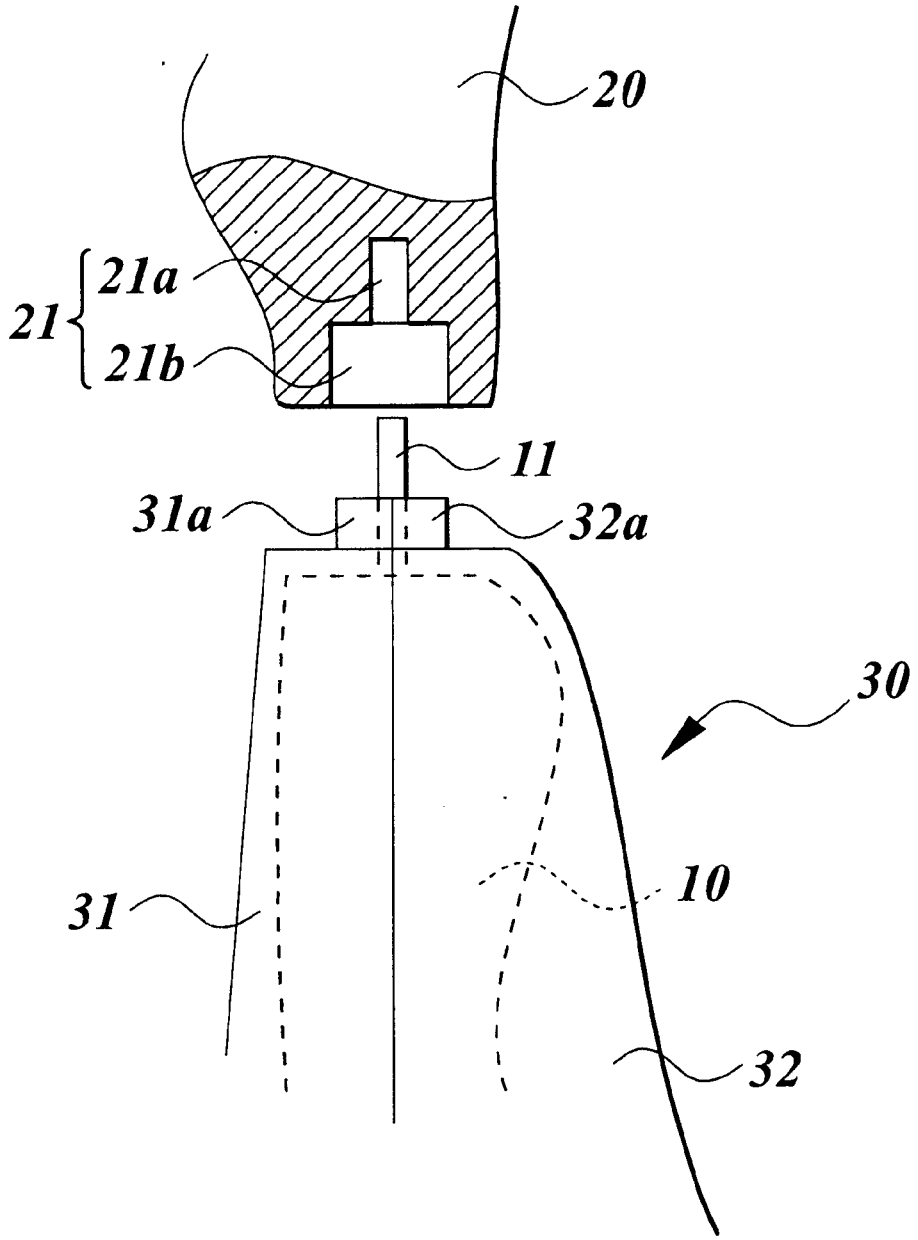
FIG. 2 is a side view showing the attachment structure of the skirt of the toy figure shown in FIG. 1.

As shown in FIG. 2, when the lower half body 10 is separated from the upper half body 20, the front skirt piece 31 and the back skirt piece 32 are attached to the lower half body 10 from the front and the rear of the lower half body 10 respectively. In the case, the upper end surfaces of the skirt pieces 31 and 32 get on the upper end surface of the lower half body 10, and the half cylindrical projections 31*a* and 32*a* of the skirt pieces 31 and 32 cover the lower portion except the top portion of the projection 11 from the front and the rear of the lower half body 10. Further, the projection 34 of the front skirt piece 31 is fitted into the concavity 33 of the back skirt piece 32. While the above-described state is kept, the lower half body 10 is connected to the upper half body 20. That is, the projections 31*a* and 32*a* of the skirt pieces 31 and 32 are fitted in the large diametrical concave portion 21*b* of the concavity 21, and the projection 11 of the lower half body 10 is fitted in the small diametrical concave portion 21*a* of the concavity 21. As described above, the skirt 30 is attached to the lower half body 10 and the upper half body 20.

Next, it will be explained how to detach the skirt 30 from the lower half body 10 and the upper half body 20 to which the skirt 30 is attached.

When the lower half body 10 and the upper half body 20 are pulled in the opposite directions to each other, the lower half body 10 and the upper half body 20 are separated from each other. At the time, the skirt 30 is separated with the lower half body 10 from the upper half body 20, or only the lower half body 10 is separated from the upper half body 20 and the skirt 30 is left attached to the upper half body 20. In case the skirt 30 is left attached to the side of the lower half body 10, the skirt pieces 31 and 32 are separated from each other. Thereby, the skirt 30 is detached from the upper half body 20 and the lower half body 10. On the other hand, in case the skirt 30 is left attached to the side of the upper half body 20, the skirt 30 is detached from the upper half body 20, and the skirt pieces 31 and 32 are separated from each other. Thereby the skirt 30 is detached from the lower half body 10 and the upper half body 20. Thereafter, as the occasion may demand, another skirt may be attached to the lower half body 10 and the upper half body 20.

Although the present invention has been explained according to the above-described embodiment, it should also be understood that the present invention is not limited to the embodiment and various changes and modifications may be made to the invention without departing from the gist thereof.

For example, according to the above-described embodiment, it has been explained that the skirt 30 comprises the front skirt piece 31 and the back skirt piece 32 which can be separated from each other forward and backward. However, the present invention can be applied to a skirt having a structure which can not be separated forward and backward. In the case, it is necessary to exactly determine front, back, right and left positions of the skirt.

Further, according to the above-described embodiment, the present invention has been explained in the case of the skirt 30 as an example. However, it is unnecessary to say that the present invention can be applied to a pair of trousers 40 as shown in FIG. 3.

Figure 3:
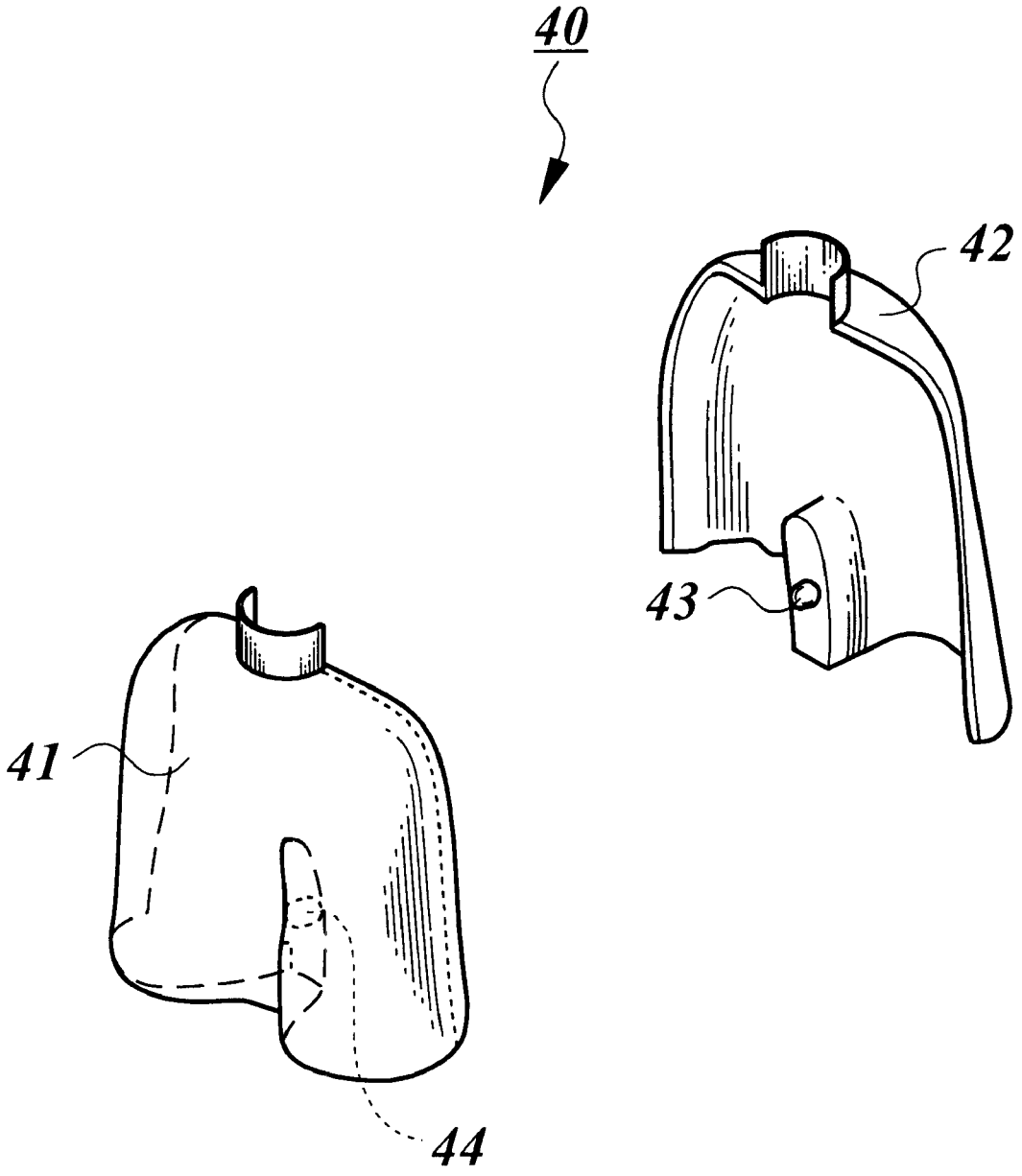
FIG. 3 is an exploded perspective view of trousers of the toy figure according to another embodiment of the present invention.
Figure 4:
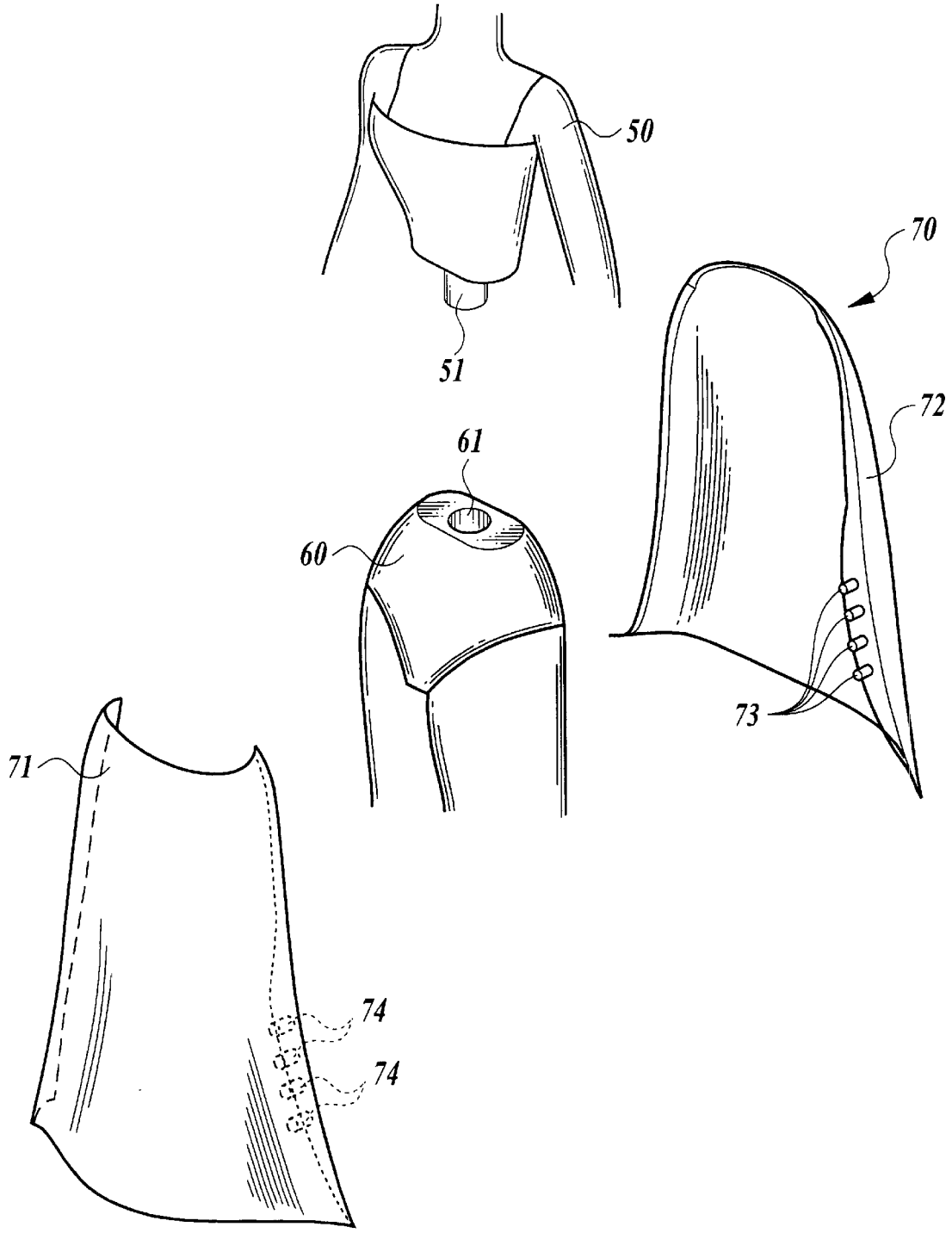
FIG. 4 is a perspective view showing an attachment structure of a skirt of a toy figure according to an earlier development.
Figure 5:
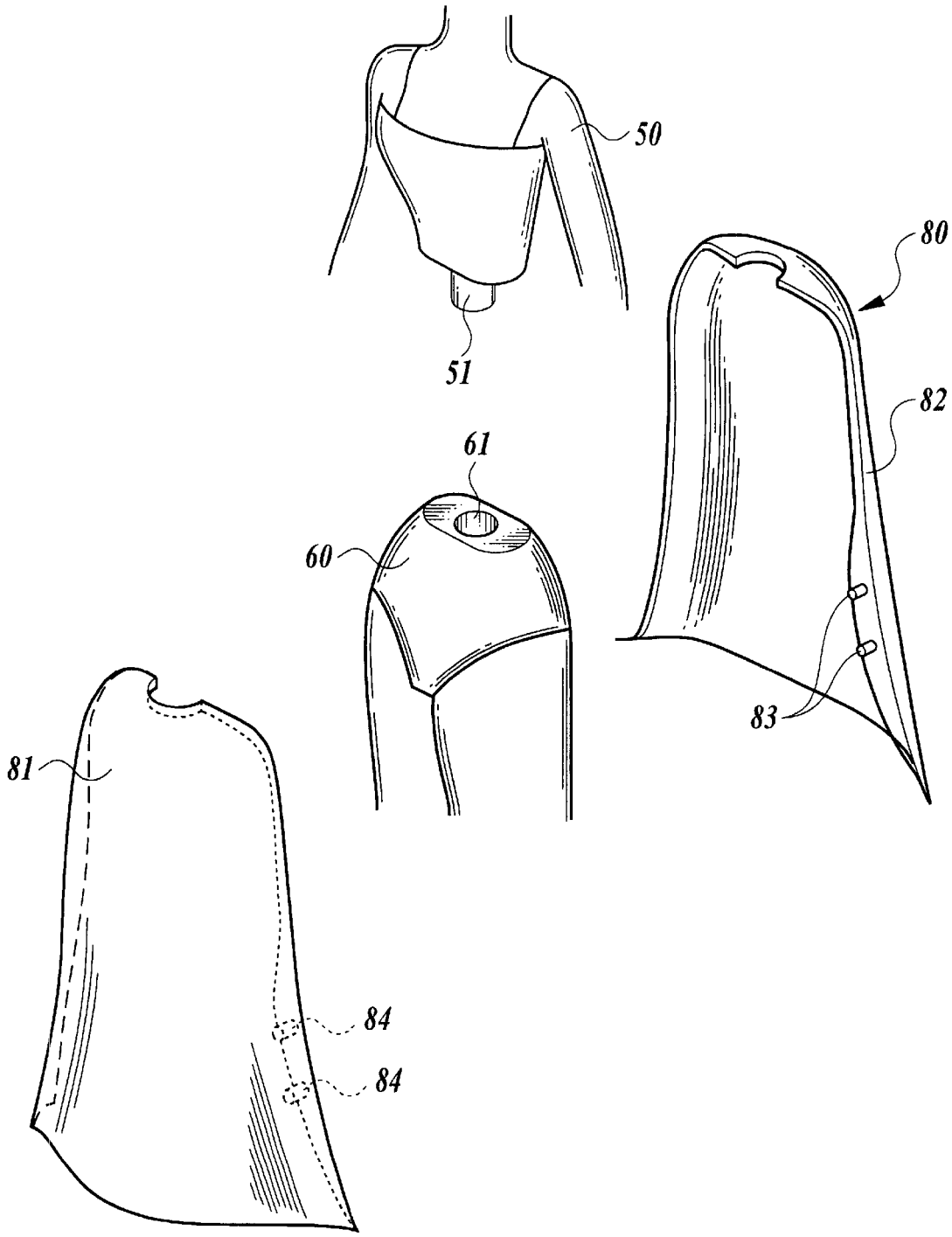
FIG. 5 is a perspective view showing an attachment structure of another skirt of the toy figure according to an earlier development.

In the case, as the FIG. 3, preferably, the trousers 40 comprise a front trousers piece 41 and a back trousers piece 42. Further, a projection 43 for positioning the back trousers piece 42 to the front trousers piece 41 is provided at a predetermined position of an inseam of the back trousers piece 42. Furthermore, a concavity 44 for positioning the front trousers piece 41 to the back trousers piece 42 is formed at a predetermined position of an inseam of the front trousers piece 41 so that the projection 43 is fitted in the concavity 44.

As well, it is preferable that the concavity 33 is formed at a predetermined position of an inseam of the back skirt piece 32, and the projection 34 is provided at predetermined position of an inseam of the front skirt piece 31.

Figure 6:
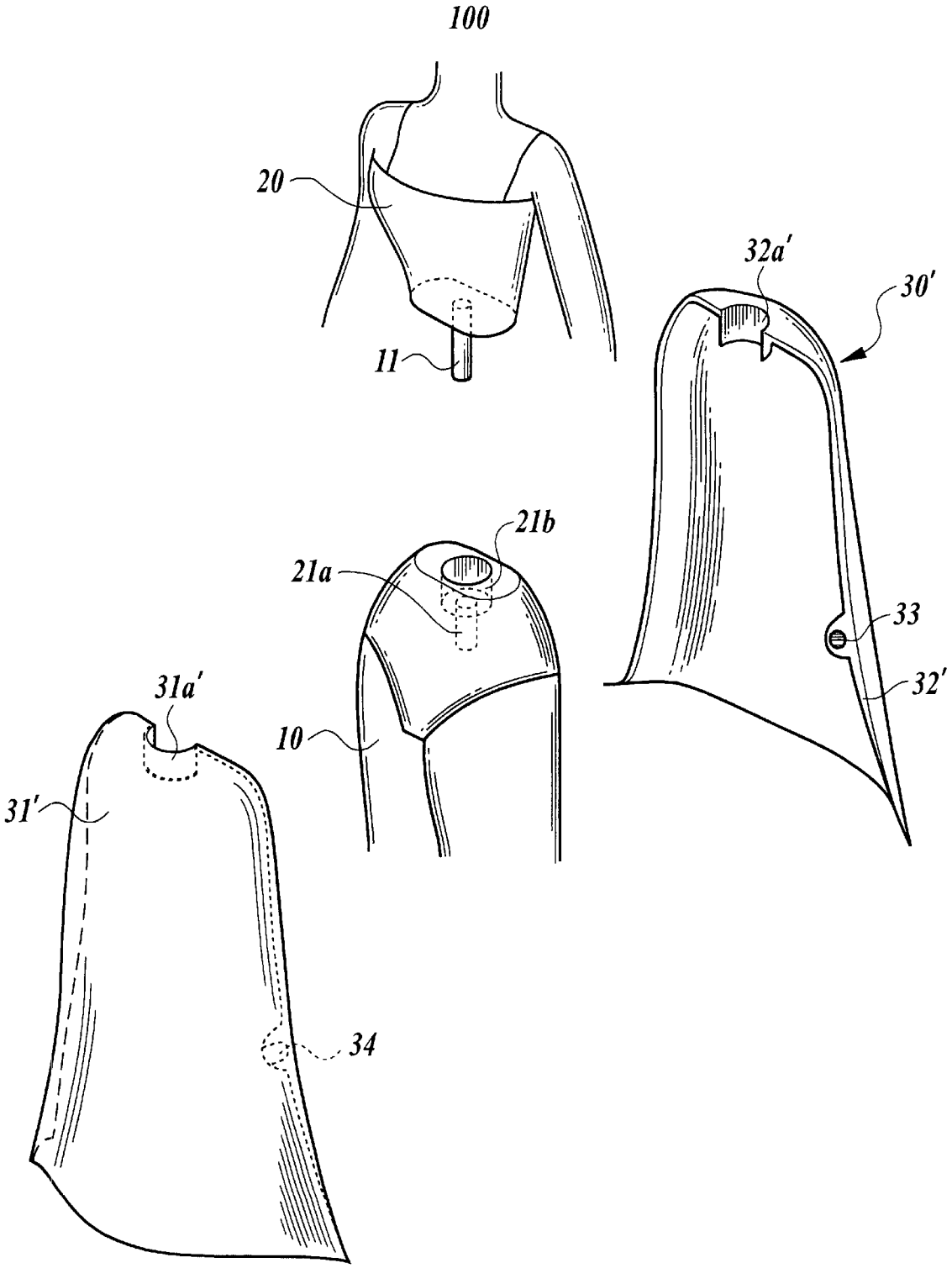
FIG. 6 is a perspective view showing an attachment structure of a skirt of the toy figure according to another embodiment of the present invention.
Figure 7:
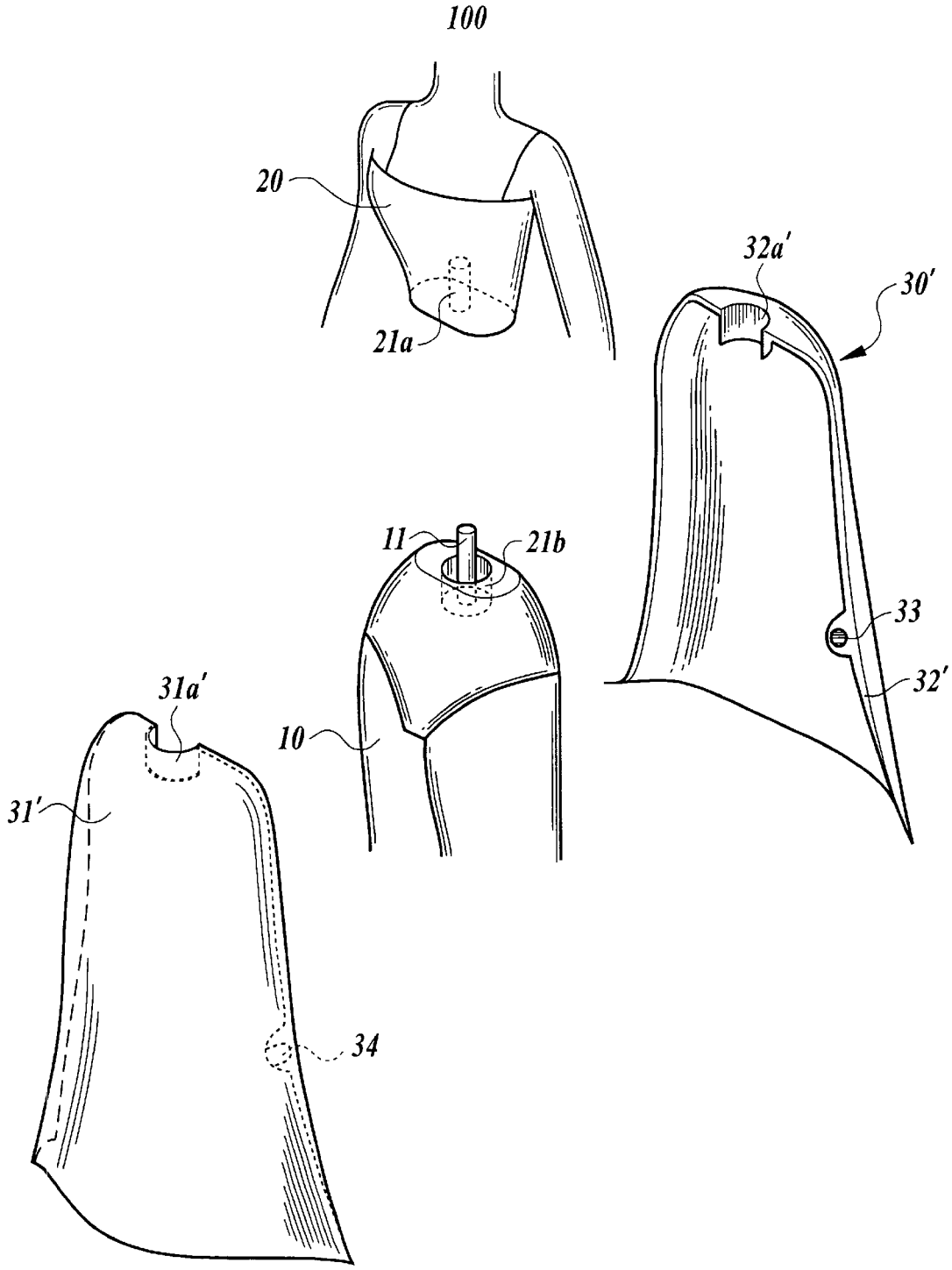
FIG. 7 is a perspective view showing an attachment structure of a skirt of the toy figure according to a further embodiment of the present invention.
Figure 8:
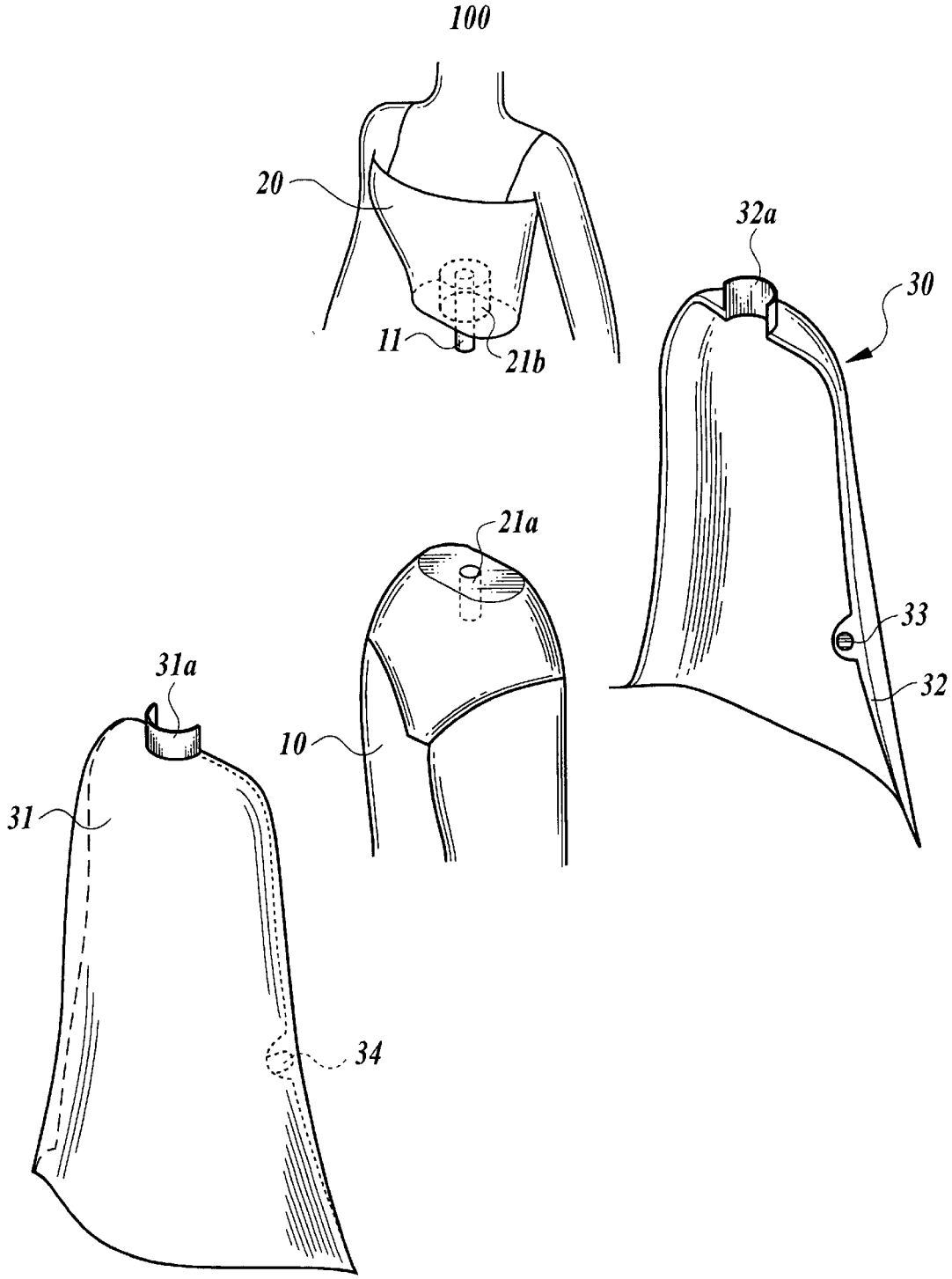
FIG. 8 is a perspective view showing an attachment structure of a skirt of the toy figure according to a furthermore embodiment of the present invention.

Furthermore, the present invention can be applied to the toy figure comprising a skirt having an attachment structure shown in any one of FIGS. 6 to 8.

As shown in FIG. 6, the toy figure 100 may comprise the upper half body 20 having the projection 11 provided on the lower end surface thereof, and the lower half body 10 having the large diametrical concave portion 21*b* formed on the upper end surface thereof and the small diametrical concave portion 21*a* formed on a bottom surface of the large diametrical concave portion 21*b*, in opposition to the case shown in FIG. 1. Further, the toy figure 100 may comprise a skirt 30' having a front skirt piece 31' and a back skirt piece 32' on upper surfaces of which half cylindrical projections 31*a*' and 32*a*' are projected to the inside. Therefore, the half cylindrical projections 31*a*' and 32*a*' of the skirt 30' are fitted in the large diametrical concave portion 21*b* of the lower half body 10, and the projection 11 of the upper half body 20 is fitted in the small diametrical concave portion 21*a* of the lower half body 10.

As shown in FIG. 7, the toy figure 100 may comprise the upper half body 20 having the small diametrical concave portion 21*a* formed on the lower end surface thereof, and the lower half body 10 having the large diametrical concave portion 21*b* formed on the upper end surface thereof and the projection 11 provided on the bottom surface of the large diametrical concave portion 21*b*. Further, the toy figure 100 may comprise the skirt 30' having the front skirt piece 31' and the back skirt piece 32' on upper surfaces of which half cylindrical projections 31*a*' and 32*a*' are projected to the inside. Therefore, the half cylindrical projections 31*a*' and 32*a*' of the skirt 30' are fitted in the large diametrical concave portion 21*b* of the lower half body 10, and the projection 11 of the lower half body 10 is fitted in the small diametrical concave portion 21*a* of the upper half body 20.

As shown in FIG. 8, the toy figure 100 may comprise the upper half body 20 having the large diametrical concave portion 21*b* formed on the lower end surface thereof and the projection 11 provided on the bottom surface of the large diametrical concave portion 21*b*, and the lower half body 10 having the small diametrical concave portion 21*a* formed on the upper end surface thereof, in opposition to the case shown in FIG. 7. Further, the toy figure 100 may comprise the skirt 30 having the front skirt piece 31 and the back skirt piece 32 on upper surfaces of which half cylindrical projections 31*a* and 32*a* are projected to the outside. Therefore, the half cylindrical projections 31*a* and 32*a* of the skirt 30 are fitted in the large diametrical concave portion 21*b* of the upper half body 20, and the projection 11 of the upper half body 20 is fitted in the small diametrical concave portion 21*a* of the lower half body 10.

According to the present invention, an effect can be indicated, as follows.

In the toy figure 100 according to the present invention, the projections 31*a* and 32*a* provided at the skirt pieces 31 and 32 are fitted in the large diametrical concave portion 21*b*, and the projection 11 provided at the lower half body 10 is fitted in the small diametrical concave portion 21*a*. As a result, because the front skirt piece 31 and the back skirt piece 32 which are capable of being separated from each other forward and backward are not only held between the upper half body 20 and the lower half boy 10 but also fixed by the fit of the projections 31*a* and 32*a* in the large diametrical concave portion 21*b*, it is possible to more effectively prevent the front skirt piece 31 and the back skirt piece 32 from getting out of fit and being separated from each other, and to realize the toy figure having the structure suitable to put on and take off the skirt.

Further, because the concavity 21 of the upper half body 20 is formed in a shape like an inverse "T", a pin made of metal, for making the shape like an inverse "T" at the predetermined position of the upper half body 20 has a shape like an inverse "T". Therefore, a bottom portion of the pin is strong. As a result, it is possible to reduce a danger of the pin's bending, warping or breaking, and to reduce a necessary cost for a maintenance of the pin.

What is claimed is:

1. A toy figure comprising:

an upper half body comprising a body concavity which is formed at a predetermined position on a lower end surface of the upper half body so as to have a small diametrical concave portion and a large diametrical concave portion below the small diametrical concave portion;

a lower half body comprising a body projection which is provided at a predetermined position on an upper end surface of the lower half body so as to be fitted in the small diametrical concave portion of the body concavity; and a bottom comprising a front bottom piece and a back bottom piece which are separated from each other in a forward direction and a backward direction and which have external half ring shaped cylindrical projections to cover a lower portion of the body projection from a front and a back side so as to be fitted in the large diametrical concave portion of the body concavity.

2. The toy figure as claimed in claim 1, wherein a bottom concavity is formed at one of the front bottom piece and the back bottom piece, and a bottom projection is provided at the other of the front bottom piece and the back bottom piece to fit in the bottom concavity.

3. The toy figure as claimed in claim 1, wherein a bottom concavity is formed at a predetermined position of a concavity-side contact portion at which the front bottom piece and the back bottom piece are contacted with each other, the bottom concavity being provided on one of the front bottom piece and the back bottom piece, and a bottom projection is provided at a predetermined position of a projection side contact portion at which the front bottom piece and the back bottom piece are contacted with each other, the bottom projection being provided on the other of the front bottom piece and the back bottom piece so as to be fitted in the bottom concavity.

4. The toy figure as claimed in claim 1, wherein a bottom concavity is formed at a predetermined position of a concavity-side inseam portion at which the front bottom piece and the back bottom piece are contacted with each other, the bottom concavity being provided on one of the front bottom piece and the back bottom piece, and a bottom projection is provided at a predetermined position of a projection side inseam portion at which the front bottom piece and the back bottom piece are contacted with each other, the bottom projection being provided on the other of the front bottom piece and the back bottom piece so as to be fitted in the bottom concavity.

5. The toy figure as claimed in claim 1, wherein the bottom is a skirt or a pair of trousers.

6. The toy figure as claimed in claim 1, wherein the upper half body, the lower half body and the bottom are comprised of molded parts made of synthetic resin.

7. A toy figure comprising:

an upper half body comprising one of a body concavity having a large diametrical concave portion and a small diametrical concave portion formed at a predetermined position on a bottom surface of the large diametrical concave portion, and a body projection, at a predetermined position on a lower end surface of the upper half body;

a lower half body comprising the other of the body concavity and the body projection at a predetermined position on an upper end surface of the lower half body so that the body projection is fitted in the small diametrical concave portion; and a bottom comprising a half ring shaped cylindrical projection to cover a portion of the body projection which is not fitted in the small diametrical concave portion, so that the ring shaped cylindrical projection is fitted in the large diametrical concave portion, on an external upper surface of the bottom when the body projection is provided on the lower half body and the body concavity is formed on the upper half body or on an internal upper surface of the bottom when the body projection is provided on the upper half body and the body concavity is formed on the lower half body.

8. A toy figure comprising:

an upper half body comprising one of a large diametrical concavity including a body projection provided at a predetermined position on a bottom surface of the large diametrical concavity, and a small diametrical concavity, at a predetermined position on a lower end surface of the upper half body;

a lower half body comprising the other of the large diametrical concavity including the body projection and the small diametrical concavity at a predetermined position on an upper end surface of the lower half body so that the body projection is fitted in the small diametrical concavity; and a bottom comprising a half ring shaped cylindrical projection to cover a portion of the body projection which is not fitted in the small diametrical concavity, so that the ring shaped cylindrical projection is fitted in the large diametrical concavity, on an external upper surface when the large diametrical concavity is formed on the upper half body and the small diametrical concavity is formed on the lower half body or on an internal upper surface when the large diametrical concavity is formed on the lower half body and the small diametrical concavity is formed on the upper half body.

9. The toy figure as claimed in claim 7, wherein the bottom comprises a front bottom piece and a back bottom piece which are separated from each other in a forward direction and a backward direction, the front bottom piece comprises a front half of the ring shaped cylindrical projection, and the back bottom piece comprises a back half of the ring shaped cylindrical projection.

10. The toy figure as claimed in claim 8, wherein the bottom comprises a front bottom piece and a back bottom piece which are separated from each other in a forward direction and a backward direction, the front bottom piece comprises a front half of the ring shaped cylindrical projection, and the back bottom piece comprises a back half of the ring shaped cylindrical projection.

11. A toy figure comprising:

a first body, comprising first and second cavities;

a second body, comprising a projection, a first portion of the projection being fitted in the first cavity, and a second portion of the projection not being fitted into the first cavity; and a cover, comprising a first piece and a second piece, each piece having a half ring shaped cylindrical projection to cover the second portion of the projection to fit the second portion of the projection in the second cavity.

12. The toy figure as claimed in claim 11, wherein the first and second cavities comprise a concave portion formed in the first body.

13. The toy figure as claimed in claim 11, wherein the second cavity is larger than the first cavity.

* * * * *